US005409531A

United States Patent [19]

Deyama et al.

[11] Patent Number: 5,409,531

[45] Date of Patent: Apr. 25, 1995

[54] RELEASING AGENT FOR DIE CASTING

[75] Inventors: Sadao Deyama, Narita; Masato Hakoiwa, Yokaichiba, both of Japan

[73] Assignee: Hitachi Powdered Metals Co., Ltd., Chiba, Japan

[21] Appl. No.: 84,172

[22] Filed: Jul. 1, 1993

[30] Foreign Application Priority Data

Jul. 1, 1992 [JP] Japan ..... 4-197539
Oct. 7, 1992 [JP] Japan ..... 4-296308

[51] Int. Cl.[6] ..... C08L 91/06; B22C 3/00

[52] U.S. Cl. ..... 106/38.25; 106/271; 106/272; 106/38.3

[58] Field of Search ..... 106/38.25, 271, 272, 106/38.23, 38.27, 38.3, 470, 483, 484, 488; 164/34, 72

[56] References Cited

U.S. PATENT DOCUMENTS 2,451,362 10/1948 Snyder ..... 106/271
2,658,004 11/1953 Eldridge ..... 106/271
3,115,414 12/1963 Lottridge ..... 106/38.23
4,044,177 8/1977 Paulus et al. ..... 427/26 X
4,609,511 9/1986 Fischer et al. ..... 264/51

FOREIGN PATENT DOCUMENTS 58-141830 8/1983 Japan .
60-174864 9/1985 Japan .
60-57411 12/1985 Japan .

*Primary Examiner*—Paul Lieberman
*Assistant Examiner*—Margaret Einsmann
*Attorney, Agent, or Firm*—Birch, Stewart, Kolasch & Birch

[57] ABSTRACT

A releasing agent of excellent heat insulating property suitably used for low speed die casting, which agent consists of an aqueous medium containing a dispersing agent and the particles of a releasing agent suspended therein, said particles of releasing agent consisting of a porous synthetic silicate compound having a specific surface area of 40 $m^2/g$ or more or said synthetic silicate compound and wax.

7 Claims, No Drawings

RELEASING AGENT FOR DIE CASTING

BACKGROUND OF THE INVENTION

1. Field of the Invention

This invention relates to a releasing agent for use in the casting operation using a die or dies. More particularly, the invention relates to a releasing agent for die casting which agent is excellent in thermal insulating property or heat retaining property and which agent is especially suitable for use in the low speed casting operation of long, large sized and complicated articles, in which the molten metal in a die is liable to be cooled and releasability is strictly required such as in the squeeze die casting of aluminum articles.

2. Description of the Prior Art

The low speed casting with a low injection speed can produce high-strength cast articles because the method is free from the gas entrainment into cast articles. Accordingly, such a casting method is widely employed in the production of aluminum parts and accessories for automobiles or the like in the recent trend of weight saving.

Most of conventional releasing agents used for die casting are graphite-base compositions. However, because the releasing agents of this kind make the working environment dirty with their inherent black color, many other white releasing agents are also used such as natural minerals of talc, sericite and pyrophyllite; and other white releasing agents of boron nitride, polytetrafluoroethylene (PTFE) and so forth.

The particles of these releasing agents are dispersed in an aqueous medium containing a dispersing agent, e.g., carboxymethyl cellulose (CMC) to form a coating composition and the composition is applied to the inside wall of the cavity of a die to form a coating film on the wall surface.

In the above-described conventional die casting method, when the temperature of a molten metal is lowered before the die is completely filled up with the molten metal, the running of molten metal is impeded and several defects such as wrinkles, cold shuts and flaws are caused to occur. Furthermore, in the casting of articles of long, large sized and complicated shape, the releasability is impaired by solidification shrinkage to cause distortion in cast articles, and in a worst case, the releasing of cast products becomes impossible.

Conventional die releasing agents are good in thermal conductivity, so that they can be used for casting small parts in simple shapes, which process is relatively free from the occurrence of defects in casting. However, the conventional releasing agents are not suitable for casting thin, complicated and large articles because several defects are caused to occur on account of misrun of molten metal.

BRIEF SUMMARY OF THE INVENTION

In view of the above-described circumstances in the conventional art, the principal object of the present invention is to provide a novel releasing agent composition which hardly causes defects in the low speed casting operation owing to its excellent thermal insulation property (heat retaining property) to produce the effect that the molten metal in a die is hardly cooled.

It is another object of the present invention to provide an improved releasing agent with good releasability for use in metal casting of large sized and complicated articles.

In order to accomplish the above objects of the present invention, the releasing agent according to the present invention comprises the particles of a porous synthetic silicate compound having a specific surface of 40 $m^2/g$ or more as releasing agent particles, which particles are suspended in water containing a dispersing agent.

In another aspect of the present invention, the particles of porous synthetic silicate compound can be used together with wax.

The synthetic silicate compound is at least one member selected from the group consisting of aluminum silicate, magnesium silicate, magnesium aluminate silicate, magnesium aluminate metasilicate, magnesium aluminate bismuth silicate and calcium silicate.

The above-mentioned wax is at least one member selected from the group consisting of sumac wax, bees wax, carnauba wax, wool wax, paraffin wax, microcrystalline wax and polyethylene wax.

Furthermore, the releasing agent of the invention can contain less than 90% by weight on solid basis of a solid substance or substances in addition to the above-mentioned particles of synthetic silicate compound and wax. The above solid substance is-at least one member selected from the group consisting of talc, sericite, pyrophyllite, boron nitride, molybdenum disulfide, tungsten disulfide, mica, enstatite, graphite fluoride, polytetrafluoroethylene, melamine cyanurate and graphite.

Still further, it is possible to add water-glass or colloidal silica to the above releasing agent composition of the present invention.

DETAILED DESCRIPTION OF THE INVENTION

The above-mentioned synthetic silicate compounds can be made by chemical synthesis like those used as a medicine of acid adsorbing agent. The compounds are porous substances with a specific surface area of 40 $m^2/g$ or more and particle sizes in the range of about 0.01 to 3 $\mu m$.

The above-mentioned waxes are exemplified by animal and vegetable waxes such as bees wax used for cosmetics, mineral wax used for wrapping and packaging materials for foods and synthetic wax such as polyethylene wax. Among the synthetic waxes, for example, polyethylene wax is prepared by high pressure polymerization of ethylene, or low pressure polymerization of ethylene in the presence of Ziegler catalyst, or by thermal cracking of high molecular weight polyethylene.

The above-mentioned eight kinds of waxes are easily available on the market at present, however, other waxes can also be employed as other waxes and their derivatives also have functions and effects like those of the above waxes.

In the case of magnesium aluminate silicate as the synthetic silicate compound, it is produced by metathesis (double decomposition) of sodium silicate, sodium aluminate and magnesium chloride. When magnesium aluminate bismuth silicate is prepared, a dilute solution of a basic magnesium compound such as magnesium carbonate is added to an aqueous solution of an aluminate and produced basic aluminate is allowed to precipitate, then a basic aluminum magnesium salt is precipitated by adding aqueous ammonia. The precipitate is then caused to react with an acidic aqueous solution of a bismuth salt to combine the basic aluminum magnesium salt with bismuth hydroxide.

The above-mentioned 6 kinds of synthetic silicate compounds are easily available on the market. It is considered that several analogous derivatives can also produce similar functions and effects.

The above-mentioned term "porous substance" includes those having numerous pores in the surfaces or in the whole bodies of particles and the aggregated particles of about 1 μm or so in diameter showing the external condition similar to that of the above materials having numerous pores. The aggregated particles are formed by joining very fine particulate materials together.

According to test results concerning the heat insulating property, the synthetic silicate compounds having a specific surface area of less than 40 $m^2/g$ is insufficient in heat insulating property. Synthetic silicate compounds having a specific surface area of more than 400 $m^2/g$ are commonly used in industrial practice, which compounds can also be used in this invention, of course.

The releasing agents according to the present invention containing the particles of only silicate compound is suitably used for casting articles of simple shapes. Furthermore, the releasing agent containing wax and silicate compound is used for casting several articles of relatively long and simple shapes because the lubricating property and heat insulating property of the agent is good enough even though the film forming property on a cavity surface is not so good.

In the case that the configuration of articles to be cast is complicated, the releasing agent further containing the above-mentioned solid lubricant particles such as talc, boron nitride or graphite fluoride so as to improve the lubricity, can be used more advantageously as compared with the former releasing agent containing the particles of only silicate compound or wax and silicate compound.

The content of synthetic silicate compound particles is 10% by weight or more on dry solid basis. When the quantity of the synthetic silicate compound particles is smaller than this value, excellent heat insulating property cannot be expected.

The content of wax is 0.1 to 20% by weight on dry solid basis. When the quantity of the wax is smaller than 0.1% by weight, the improvement in lubricity cannot be expected. On the other hand, when the content of wax exceeds 20% by weight, the outgassing increases and the defects of products caused by the gas involution is caused to occur. Among the above-mentioned solid lubricant particles, it is desirable that the quantities of graphite and molybdenum disulfide are made as small as possible because their color is black.

In the case that the adhesiveness of coating film of releasing agent is required in view of the size and the configuration of article to be cast, an additive such as water-glass or colloidal silica may be added to the suspension of the releasing agent. The addition quantity of this additive is desirably in the range of about 2 to 15% by weight on solid basis.

Incidentally, a thick suspension of releasing agent is usually prepared in the first place, and when it is practically used, the concentrated suspension is diluted with water in consideration of several conditions such as size and configuration of die and conditions of applying the releasing agent.

The particle of conventionally used natural mineral material such as talc and boron nitride consists of a single crystalline particle and the thermal conductivity of the particle itself is high. When a releasing agent containing such a material is applied to the cavity surface of a die and molten metal is then poured in, the heat of molten metal is readily transmitted to the body of die, which results in the lowering of the temperature of molten metal and the flow of molten metal is impaired.

The synthetic silicate compounds are porous substances. When a coating film is formed with a synthetic silicate compound, numerous finely dispersed voids are formed in the coating film and the film shows excellent heat insulating property. Owing to this function, the lowering of the temperature of molten metal can be retarded and the running of molten metal can be improved accordingly. When the wax is added to the releasing agent, the agent having good lubricating and releasing properties can be formed because the wax held among the particles of synthetic silicate compound becomes liquid or vapor to improves the flowability of the particles of silicate compound during the casting operation.

In addition, it is to be noted that the synthetic silicate compound and wax do not make the working environment dirty because they are white substances. The synthetic silicate compound is porous and is brittle as compared with natural minerals and the silicate compound is subjected to cleavage just like the solid lubricant such as molybdenum disulfide, so that the synthetic silicate compound also produces lubricating effect similar to the lubrication mechanism of the solid lubricant.

The present invention will be understood more readily by reference to the following examples; however, these examples are intended to illustrate the invention and are not to be construed to limit the scope of the invention.

EXAMPLE

Several kinds of inorganic powders, each 20% by weight, were added so slowly as not to form aggregated lumps, into an aqueous solution containing 2% by weight of CMC as a dispersing agent. They were stirred sufficiently to prepare suspensions of inorganic powders.

Meanwhile, 10% by weight of emulsifying agent (polyoxyethylene alkyl ether) and each 20% by weight of waxes were mixed together and they were stirred well. Each mixture was dispersed into 70% by weight of water with agitation using a homogenizer to obtain a wax emulsion. Several quantities of the above two kinds of liquids were mixed together to prepare test samples.

Shown in the following Table 1 are the kinds of inorganic powder materials used and specific surface areas of them, respectively. The talc, sericite, boron nitride and graphite in Table 1 are conventionally used inorganic powders for preparing releasing agents. Meanwhile, magnesium aluminate silicate, aluminum silicate and magnesium silicate are the synthetic silicate compounds used according to the present invention.

In Tables 2A to 2D are indicated compositions of used materials as 100% by weight in total of inorganic powder materials and waxes, and resultant values in heat insulating properties and coefficients of friction of the coating films formed with these releasing agents.

TABLE 1

| Inorganic Powder Material | Specific Surface Area ($m^2/g$) |
|---|---|
| A. Talc (Natural magnesium silicate) | 15 |
| B. Sericite (Natural basic aluminum potassium silicate) | 22 |
| C. Boron nitride | 5 |
| D. Graphite | 40 |
| E. Synthetic magnesium aluminate silicate | 110 |
| F. Synthetic aluminum silicate | 100 |
| G. Synthetic magnesium silicate | 75 |

TABLE 2A

| | Comparative Samples | | | |
|---|---|---|---|---|
| Test Number | 1 | 2 | 3 | 4 |
| Talc | 100 | — | — | — |
| Sericite | — | 100 | — | — |
| Boron nitride | — | — | 100 | — |
| Graphite | — | — | — | 100 |
| Paraffin wax | — | — | — | — |
| Polyethylene wax | — | — | — | — |
| Magnesium aluminate silicate | — | — | — | — |
| Aluminum silicate | — | — | — | — |
| Magnesium silicate | — | — | — | — |
| Heat Insulating Property (sec.) | 118 | 120 | 115 | 102 |
| Coefficient of Friction | 0.27 | 0.31 | 0.24 | 0.07 |

TABLE 2B

| | Samples of This Invention | | | | | |
|---|---|---|---|---|---|---|
| Test Number | 5 | 6 | 7 | 8 | 9 | 10 |
| Talc | — | — | — | — | — | — |
| Sericite | — | — | — | 30 | — | — |
| Boron nitride | — | — | — | — | — | — |
| Graphite | — | — | — | — | — | — |
| Paraffin wax | — | — | — | — | — | — |
| Polyethylene wax | — | — | — | — | 5 | 10 |
| Magnesium aluminate silicate | 100 | — | — | 70 | 95 | 90 |
| Aluminum silicate | — | 100 | — | — | — | — |
| Magnesium silicate | — | — | 100 | — | — | — |
| Heat Insulating Property (sec.) | 195 | 192 | 187 | 183 | 191 | 187 |
| Coefficient of Friction | 0.40 | 0.41 | 0.42 | 0.50 | 0.07 | 0.05 |

TABLE 2C

| | Samples of This Invention | | | | |
|---|---|---|---|---|---|
| Test Number | 11 | 12 | 13 | 14 | 15 |
| Talc | — | — | — | — | 30 |
| Sericite | — | — | — | — | — |
| Boron nitride | — | — | — | — | — |
| Graphite | — | — | — | — | — |
| Paraffin wax | — | 10 | 10 | 10 | — |
| Polyethylene wax | 15 | — | — | — | 10 |
| Magnesium aluminate silicate | 85 | 90 | — | — | 60 |
| Aluminum silicate | — | — | 90 | — | — |
| Magnesium silicate | — | — | — | 90 | — |
| Heat Insulating Property (sec.) | 185 | 189 | 185 | 180 | 172 |
| Coefficient of Friction | 0.03 | 0.05 | 0.09 | 0.10 | 0.04 |

TABLE 2D

| | Samples of This Invention | | | | |
|---|---|---|---|---|---|
| Test Number | 16 | 17 | 18 | 19 | 20 |
| Talc | — | — | — | — | — |
| Sericite | 30 | 45 | 45 | 30 | 25 |
| Boron nitride | — | 5 | — | — | — |
| Graphite | — | — | 5 | — | — |
| Paraffin wax | — | — | — | — | — |
| Polyethylene wax | 10 | 5 | 5 | 10 | 15 |
| Magnesium aluminate silicate | 60 | 45 | 45 | 30 | 60 |
| Aluminum silicate | — | — | — | 30 | — |
| Magnesium silicate | — | — | — | — | — |
| Heat Insulating Property (sec.) | 177 | 166 | 163 | 174 | 178 |
| Coefficient of Friction | 0.03 | 0.11 | 0.03 | 0.07 | 0.02 |

The heat insulating properties of the coating films of releasing agents were evaluated by the flowing procedure.

The sizes of die were 240 mm×60 mm×220 mm (height) with 20 mm in thickness having a cavity of 20mm×200 mm×200 mm (depth). The die was provided at its top face with a sprue hole and a thermocouple to measure the temperature at the center of the cavity. The die was such a type that it could be split vertically into two parts and be assembled with bolts.

The die was disassembled and heated to 150° C. Each of the above-mentioned suspension samples was diluted 10 times and it was sprayed to the inside surface of the die to form a coating film of about 5 μm in dry thickness. After that the halves of die were assembled and heated to 240° C. and molten aluminum (AC4C, JIS H 5202; 7.0% Si-0.4% Mg-bal. Al) of 720° C. was teemed into the die. Then, the time of solidification was measured.

The lubricity of formed coating films were evaluated with coefficients of friction which were measured by ring compression test method. More particularly, a pair of dies were used. Each die was 60 mm in diameter and 50 mm in height and was made of alloy tool steel SKD 61 (JIS G 4404; 0.35 C-5.0 Cr-1.2 Mo-1.0 V-bal. Fe) were used.

These dies were heated to 160° C. The above suspension of releasing agent was diluted by ten times with water and the diluted liquid was sprayed evenly to the die surfaces to form a coating film of 5μm in dried thickness. After that, a test piece (aluminum AC4C, 20 mm in outer diameter, 10 mm in inner diameter and 5 mm in height) was heated to 400° C. and it was pinched by the coated surfaces of the above two dies. They were then pressed by Amsler testing machine with a compression ratio of 40%. The coefficient of friction was calculated with the ratio of compression and the ratio of change of inner diameter of each test piece.

As shown in Table 2A, the times of solidification which are represented by "Heat Insulating Property", were 120 seconds or less in Samples 1 to 4 of talc, sericite, boron nitride and graphite. Meanwhile, the times of solidification of Samples 5 to 7 using magnesium aluminate silicate, aluminum silicate or magnesium silicate according to the present invention were about 190 seconds as shown in Table 2B, from which the advantage in heat insulating effect can be noticed. However, the coefficients of friction were 0.40 or higher, which is not so good.

In Samples 9 to 14 according to the present invention in which the synthetic silicate compound and wax were used in combination, the values of heat insulating property (solidification time) were as good as 180 to 191 and the coefficients of friction were also as good as 0.03 to 0.10.

Furthermore, as shown in Tables 2C to 2D for Samples 15 to 20 in which conventional inorganic powders were added to the composition of the present invention, it was noticed that both the heat insulating effect and lubricating property were improved.

The relation between the values in heat insulating property and coefficient of friction and the compounding ratios of wax and magnesium aluminate silicate were known from the comparison of the results of Samples 5, 9, 10 and 11. That is, the heat insulating property of the Sample 5 of magnesium aluminate silicate only was highest but the lubricity is not good because the coefficient of friction is high. When 5, 10 and 15% by weight of wax is added to the above Sample 5 as shown in Samples 9, 10 and 11, the coefficients of friction were markedly lowered to improve the lubricity without impairing the heat insulating property.

As described above, because the releasing agent of the present invention is excellent in heat insulating property and lubricating property, the rate of lowering of the temperature of molten aluminum in a die can be retarded and the teeming operation of molten metal can be improved. Therefore, it is made possible to produce high quality aluminum cast articles of long and complicated configuration through the low speed injection casting with the improvement in the running of molten metal and the lowering of coefficient of friction.

What is claimed is:

1. A releasing composition for use in die casting which comprises an aqueous medium containing a dispersing agent and particles of at least one releasing agent suspended in said aqueous medium, said releasing agent comprising on a dry solid basis about 0.1 to 20% by weight wax particles and at least about 10% by weight particles of a porous synthetic silicate compound having a specific surface area of 40 $m^2/g$ or more.

2. The releasing agent as claimed in claim 1, wherein said synthetic silicate compound is at least one member selected from the group consisting of aluminum silicate, magnesium silicate, magnesium aluminate silicate, magnesium aluminate metasilicate, magnesium aluminate bismuth silicate and calcium silicate.

3. The releasing agent as claimed in claim 1, wherein said synthetic silicate compound is at least one member selected from the group consisting of aluminum silicate, magnesium silicate, magnesium aluminate silicate, magnesium aluminate metasilicate, magnesium aluminate bismuth silicate and calcium silicate; and said wax is at least one member selected from the group consisting of sumac wax, bees wax, carnauba wax, wool wax, paraffin wax, microcrystalline wax and polyethylene wax.

4. The releasing agent as claimed in claim 1, wherein said releasing agent further contains less than 90% by weight on solid basis of additional particles of a solid material which material is at least one member selected from the group consisting of talc, sericite and pyrophyllite, boron nitride, molybdenum disulfide, tungsten disulfide, mica, enstatite, graphite fluoride, polytetrafluoroethylene, melamine cyanurate and graphite.

5. The releasing agent as claimed in claim 1, wherein said releasing agent further contains water-glass or colloidal silica.

6. The releasing composition as claimed in claim 1, wherein said dispersing agent is carboxymethyl cellulose.

7. The releasing composition as claimed in claim 1, wherein said porous synthetic silicate compound is in the form of a particle having a particle size in the range 0.01 to 3 $\mu$m.

* * * * *